US007275281B2

(12) United States Patent
Park

(10) Patent No.: US 7,275,281 B2
(45) Date of Patent: Oct. 2, 2007

(54) MOTOR ASSEMBLY AND VACUUM CLEANER HAVING THE SAME

(75) Inventor: Jung-seon Park, Gwangju (KR)

(73) Assignee: Samsung Electronics Co., Ltd., Gwangju (KR)

( * ) Notice: Subject to any disclaimer, the term of this patent is extended or adjusted under 35 U.S.C. 154(b) by 542 days.

(21) Appl. No.: 10/851,243

(22) Filed: May 24, 2004

(65) Prior Publication Data

US 2005/0005391 A1 Jan. 13, 2005

(30) Foreign Application Priority Data

Jul. 7, 2003 (KR) ..... 10-2003-0045759

(51) Int. Cl.
*A47L 9/16* (2006.01)

(52) U.S. Cl. ..... 15/347; 15/350; 15/351; 15/353; 15/412; 55/DIG. 3; 55/337

(58) Field of Classification Search ..... 15/347, 15/412, 350, 351, 353; 55/DIG. 3, 337
See application file for complete search history.

(56) References Cited

U.S. PATENT DOCUMENTS

| | | | | |
|---|---|---|---|---|
| 3,218,783 | A * | 11/1965 | Ripple | 15/350 |
| 4,213,224 | A | 7/1980 | Miller | |
| 4,586,214 | A | 5/1986 | Berfield | |
| 5,102,435 | A | 4/1992 | Rau et al. | |
| 5,548,867 | A * | 8/1996 | Hwang et al. | 15/412 |
| 5,898,971 | A * | 5/1999 | Contant | 15/412 |
| 6,070,289 | A * | 6/2000 | Lee et al. | 15/412 |
| 6,269,518 | B1 | 8/2001 | Yung | |
| 6,289,553 | B1 | 9/2001 | Dyson | |
| 6,341,404 | B1 * | 1/2002 | Salo et al. | 15/353 |
| 6,553,611 | B2 * | 4/2003 | Huebsch et al. | 15/412 |
| 6,589,309 | B2 * | 7/2003 | Oh et al. | 55/DIG. 3 |
| 6,845,543 | B2 * | 1/2005 | Kim | 15/412 |

FOREIGN PATENT DOCUMENTS

| | | |
|---|---|---|
| DE | 197 39 613 A1 | 3/1998 |
| GB | 2373174 | 3/2003 |

(Continued)

OTHER PUBLICATIONS

Combined Search and Examination Report under Sections 17 and 18(3) dated Oct. 20, 2004.

(Continued)

*Primary Examiner*—Theresa T. Snider
(74) *Attorney, Agent, or Firm*—Blank Rome LLP

(57) ABSTRACT

A motor assembly for a vacuum cleaner for providing a user with a quieter environment during a cleaning work, and a vacuum cleaner having the same, is disclosed. The motor assembly includes a motor generating a suction force, an auxiliary filter member disposed on an airflow path connecting the motor to a dust-collecting apparatus for filtering a second time the air discharged from the dust-collecting apparatus, and a motor casing. The motor casing includes a first chamber connected to the dust-collecting apparatus with the auxiliary filter member mounted therein. A second chamber is connected to a discharge opening of the cleaner body and includes the motor mounted therein. A connection path is in fluid communication with the first chamber and the second chamber.

22 Claims, 7 Drawing Sheets

FOREIGN PATENT DOCUMENTS

| | | |
|---|---|---|
| JP | 01 209035 A | 8/1989 |
| JP | 09-154779 | 6/1997 |
| JP | 11-032947 | 2/1999 |
| JP | 2001-037687 | 2/2001 |
| JP | 2002-125898 A | 5/2002 |
| KR | 2003-0011394 | 2/2003 |
| KR | 2003-0035629 | 5/2003 |

OTHER PUBLICATIONS

British Patent Office, Combined Search and Examination Report issued Jun. 3, 2005 with respect to British Patent Application No. 0412121.6 filed on May 29, 2004.

British Patent Office, Combined Search and Examination Report issued Jan. 10, 2006 with respect to British Divisional Patent Application No. 0524738.2 filed on Dec. 2, 2005.

Chinese Patent Office, Office Action issued Jan. 6, 2006 with respect to Chinese Patent Application No. 200410048794.5 filed on Jun. 18, 2004.

Australian Patent Office, Office Action issued Aug. 5, 2005 with respect to Australian Patent Application No. 2004202417 filed on May 31, 2004.

Russian Patent Office, Office Action issued Jul. 18, 2005 with respect to Russian Patent Application No. 2004120671 filed on Jul. 6, 2004.

Canadian Patent Office, Office Action issued Jan. 30, 2007 with respect to Canadian Patent Application No. 2,470,987 filed on Jun. 15, 2004.

* cited by examiner

MOTOR ASSEMBLY AND VACUUM CLEANER HAVING THE SAME

REFERENCE TO RELATED APPLICATION

This application claims priority to copending Korean Patent Application No. 2003-45759, filed on Jul. 7, 2003, in the Korean Intellectual Property Office, the disclosure of which is entirely incorporated herein by reference.

CROSS REFERENCE TO RELATED APPLICATIONS

This application is related to copending applications entitled "Dust Collecting Apparatus For Cyclone Type Vacuum Cleaner", (Korean Application 10-2003-0012029, filed Feb. 26, 2003), "Cyclone-Type Dust Collecting Apparatus For Vacuum Cleaner", (Korean Application 10-2002-0077811, filed Dec. 9, 2002), and "Cyclone Type Dust Collecting Apparatus of Vacuum Cleaner", (Korean Application 10-2003-0033167, filed May 24, 2003) which disclosures are commonly owned by the same assignee as the present application and are entirely incorporated herein by reference.

FIELD OF THE INVENTION

The present invention relates to a vacuum cleaner, and more particularly, to a motor assembly disposed in a vacuum cleaner to generate a suction force, by which dirt is drawn in from a cleaning surface.

BACKGROUND OF THE INVENTION

A general vacuum cleaner performs cleaning work by drawing in dirt together with ambient air from a cleaning surface while traveling along the cleaning surface. The vacuum cleaner includes a cleaner body and a suction assembly. FIG. 1 is a view showing an appearance of an upright type vacuum cleaner as an example of the above-described general vacuum cleaner, and FIG. 2 is a view showing the cleaner body of the vacuum cleaner of FIG. 1.

Referring to FIGS. 1 and 2, a conventional upright type vacuum cleaner 100 includes a suction assembly 110, a cleaner body 120, a dust-collecting apparatus 130, and a motor assembly 150. The suction assembly 110 has an opening for drawing in dirt (not shown) formed in a bottom thereof from a cleaning surface therethrough. The cleaner body 120 is pivotably connected to one side of the suction assembly 110, and has a discharge opening 127 formed in a rear portion to discharge the air therethrough as the air is drawn in through the dirt-suctioning opening and filtered by the dust-collecting apparatus 130. A front casing 121 and a rear casing 122 form the exterior contour of the cleaner body 120.

The dust-collecting apparatus 130 separates dirt from air that is drawn in through the suction assembly 110. As shown in FIGS. 1 and 2, the vacuum cleaner 100 employs a cyclone dust-collecting apparatus 130 which is mounted in a dust-collecting chamber 125 of the cleaner body 120. The dust-collecting apparatus separates dirt using a centrifugal force generated by swirling the air entering into the cyclone dust-collecting apparatus 130, and also includes an auxiliary filter assembly 140 for filtering a second time the air discharged from the cyclone dust-collecting apparatus 130. Meanwhile, an ascending/descending unit 160 ascends/descends a dirt-collecting receptacle 135 of the cyclone dust-collecting apparatus 130 in the dust-collecting chamber 125 to connect/disconnect the dirt-collecting receptacle 135 to/from a cyclone head portion 131 fixed to an upper end of the dust-collecting chamber 125 of the cleaner body 120.

The motor assembly 150 generates a suction force at the dirt-suctioning opening and is disposed in the cleaner body 120 and is in fluid communication with the dirt-suctioning opening. The motor assembly 150 includes a motor casing 153 for covering the exterior of a motor 305 (see FIG. 4) which generates the suction force. The motor casing 153 also guides the air discharged from the auxiliary filter assembly 140 to the discharge opening 127 of the cleaner body 120.

In a conventional vacuum cleaner 100 with the above construction, since the motor assembly 150 and the auxiliary filter assembly 140 are constructed independently from each other, an airflow path for connecting the motor assembly 150 and the auxiliary assembly 140 is additionally required. Further, a sealing device is also required to seal the airflow path. Also, in situations where the airflow path is provided to connect the motor assembly 150 and the auxiliary filter assembly 140, since noise occurs during operation in the connection portions of the airflow path and the motor assembly 150 and the auxiliary filter assembly 140, there is a problem that a user cannot enjoy a quiet cleaning work. Furthermore, due to the addition of the extra airflow path and the sealing device, a manufacturing process of the vacuum cleaner 100 becomes more complicated and a manufacturing cost is increases.

Thus, a heretofore unaddressed need exists in the industry to address the aforementioned deficiencies and inadequacies.

SUMMARY OF THE INVENTION

The present invention has been developed to solve the problems in the related art. Accordingly, it is an object of the present invention to provide a motor assembly for a vacuum cleaner with an improved construction which provides a user with a quieter environment during a cleaning work by reducing a noise from the driving operation of the vacuum cleaner, and a vacuum cleaner having the same.

The above aspect is achieved by providing a motor assembly for a vacuum cleaner comprising a motor generating the suction force and an auxiliary filter member disposed in an airflow path connecting the motor to a dust-collecting apparatus in which dirt is separated from external air drawn in by the suction force. The auxiliary filter member filters a second time the air discharged from the dust-collecting apparatus. A motor casing includes a first chamber and a second chamber divided therein, and a connection path in fluid connection with the first chamber and the second chamber. The first chamber is connected to the dust-collecting apparatus and includes the auxiliary filter member mounted therein, the second chamber being connected to a discharge opening of the cleaner body and including the motor mounted therein.

According to an embodiment of the present invention, one side of the first chamber includes an entrance opening which penetrates through an outer wall of the cleaner body and is exposed to the outside of the cleaner body, and the auxiliary filter member is removably mounted in the first chamber through the entrance opening. The motor casing may further include a mounting member removably mounted in the first chamber through the entrance opening wherein the mounting member includes a supporting portion supporting the auxiliary filter member. A cover is disposed at one side of the supporting portion and covers the entrance opening when the supporting portion is inserted into the first chamber to block the entrance opening from the outside of the cleaner body. A sealing member is disposed along at least one edge of the entrance opening.

Meanwhile, the motor casing includes a first casing in which the first chamber is formed, and includes a first port in fluid communication with the first chamber and the dust collecting apparatus, and a second casing connected to the first casing to form the second chamber in the motor casing, with a second port connecting the second chamber to the discharge opening of the vacuum cleaner. The connection path includes a connection hole penetratingly formed in one side of the first casing to connect the first and the second chambers when the first and the second casings are connected to each other.

The second casing includes a guide duct guiding air which is drawn into the second chamber through the connection hole so that the air swirls in the second casing along a circumferential direction of the motor by a predetermined distance, and is then discharged through the second port.

According to another aspect of the present invention, a vacuum cleaner includes a suction assembly with a dirt-suctioning opening formed in a lower surface thereof, and a cleaner body pivotably disposed at one side of the suction assembly with a dust-collecting chamber and a discharge opening sequentially disposed therein and in fluid communication with the dirt-suctioning opening. A motor assembly is disposed in the cleaner body to generate a suction force at the dirt-suctioning opening, with an upper outside wall forming a bottom of the dust-collecting chamber, and a dust-collecting apparatus disposed in the dust-collecting chamber to separate dirt from external air drawn in through the dirt-suctioning opening. The motor assembly includes a motor generating the suction force, and a motor casing with a first chamber and a second chamber divided therein, and a connection path in fluid communication with the first chamber and the second chamber. The first chamber is in fluid communication with the dust-collecting apparatus and includes an auxiliary filter member mounted therein for filtering a second time the air discharged from the collecting apparatus. The second chamber is connected to a discharge opening of the cleaner body and includes the motor mounted therein.

The dust-collecting apparatus may include a cyclone dust-collecting apparatus which separates dirt from air using a centrifugal force generated by swirling the air drawn in through the dirt-suctioning opening. The cyclone dust-collecting apparatus also includes a cyclone head portion fixed to an upper end of the dust-collecting chamber in fluid communication with the dirt-suctioning opening and the motor casing. A dirt-collecting receptacle is removably disposed at a lower end of the cyclone head portion to form a cyclone chamber. Dirt is centrifugally separated at the cyclone chamber and is collected on the dirt-collecting receptacle.

The dust-collecting chamber may be provided with an ascending/descending unit ascending the dirt-collecting receptacle. The dust-collecting chamber is inserted into the dust-collecting chamber to connect the dirt-collecting receptacle to the cyclone head portion. The ascending/descending unit is disposed on an upper outside wall of the motor assembly. Also, the ascending/descending unit may include a lever pivotably disposed at the upper outside wall of the motor assembly, a disk disposed on an upper portion of the level member in a vertically movable manner for supporting a lower surface of the dirt-collecting receptacle inserted in the dust-collecting chamber, and a cam driving unit disposed between the level member and the disk for ascending/descending the disk when the lever pivots.

According to another embodiment of the present invention, a motor assembly of a vacuum cleaner includes a motor generating the suction force and a motor casing with a chamber formed therein to mount the motor. A first port connects the chamber to a dust-collecting apparatus and separates dirt from the external air drawn into the cleaner body by the suction force. A second port connects the chamber to a discharge opening of the cleaner body. The motor casing includes a guide duct guiding the air drawn in through the first port so that the air swirls in the motor casing along a circumferential direction of the motor by a predetermined distance and is discharged through the second port.

According to the present invention as described above, since the motor casing and the auxiliary filter member are assembled with each other in an integrated form, the motor assembly prevents the noise during the driving of the vacuum cleaner, thus providing a user with a quieter environment. Also, both a manufacturing process and manufacturing cost of the vacuum cleaner are reduced.

Other systems, methods features, and advantages of the present invention will be or become apparent to one with skill in the art upon examination of the following drawings and detailed description. It is intended that all such additional systems, methods, features, and advantages be included within that description, be within the scope of the present invention, and be protected by the accompanying claims.

BRIEF DESCRIPTION OF THE DRAWINGS

The above aspect and other advantages of the present invention will be more apparent by describing an exemplary embodiment of the present invention with reference to the accompanying drawings. The components in the drawings are not necessarily to scale, emphasis instead being placed upon clearly illustrating the principles of the present invention. Moreover, in the drawings, like reference numerals designate corresponding parts throughout the general views.

DETAILED DESCRIPTION OF THE PREFERRED EMBODIMENT

Figure 1:
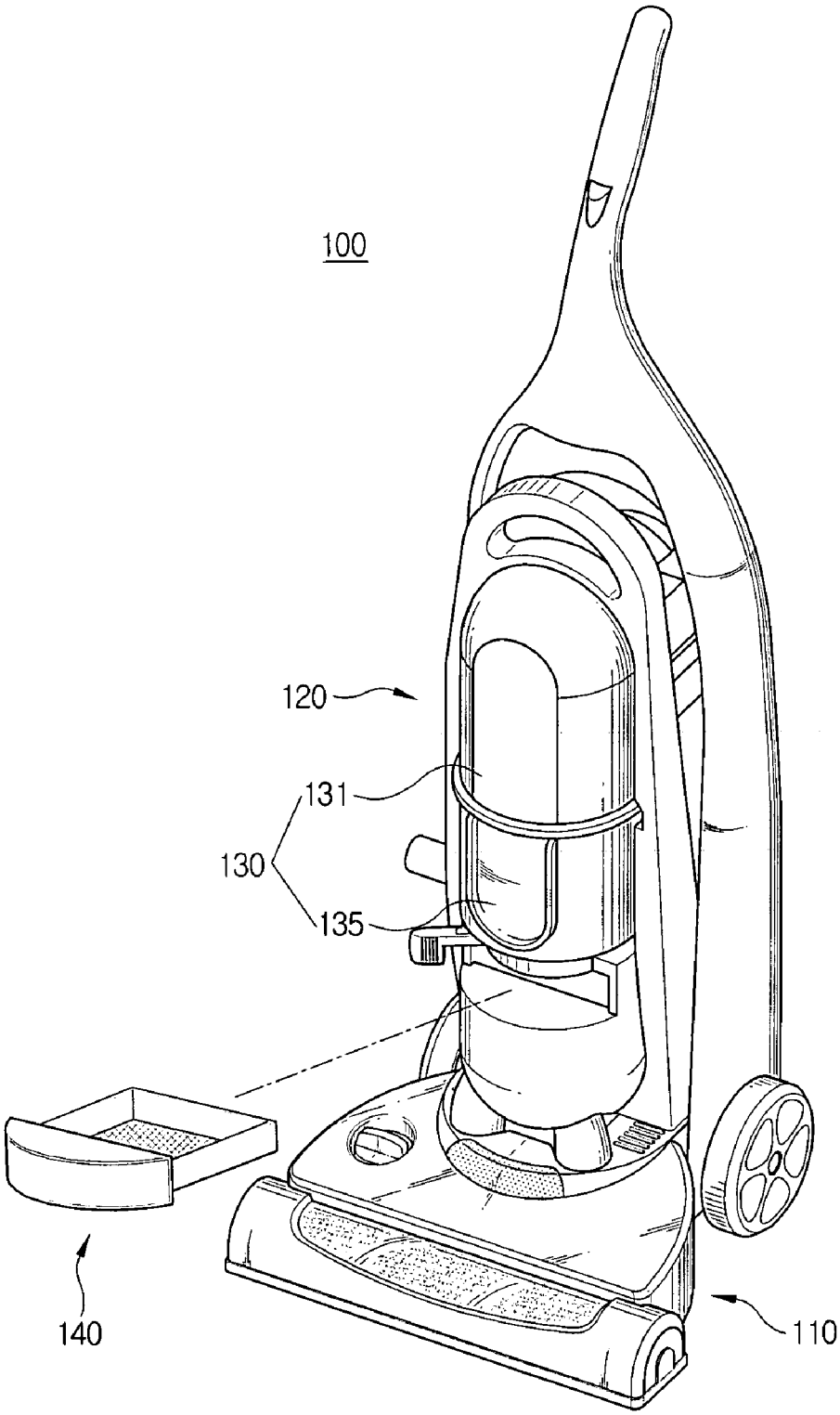
FIG. 1 (PRIOR ART)
FIG. 1 is a drawing of a perspective view showing an appearance of an upright type vacuum cleaner as an example of a conventional vacuum cleaner.
Figure 2:
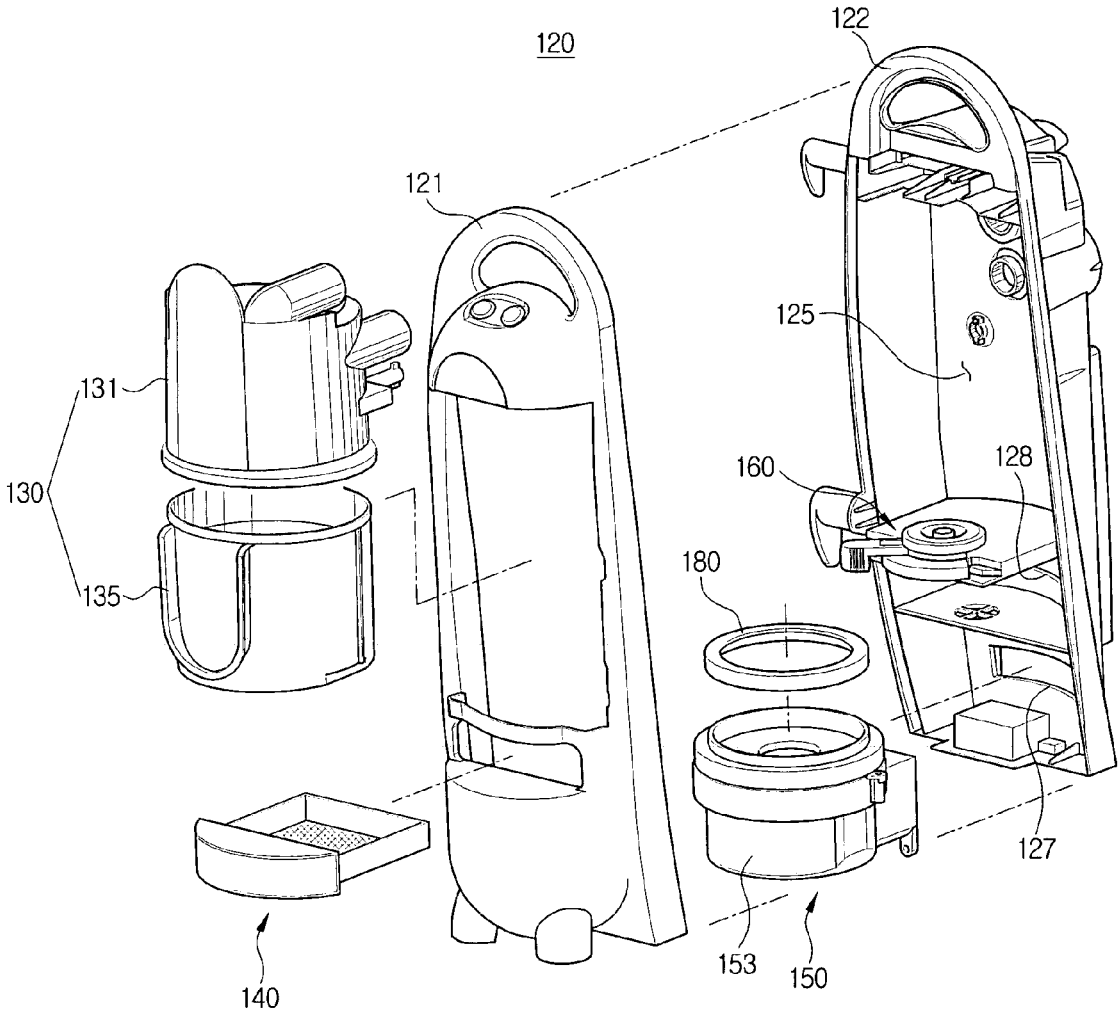
FIG. 2 (PRIOR ART)
FIG. 2 is a drawing of an exploded perspective view showing the cleaner body of FIG. 1.

Hereinafter, a preferred embodiment of the present invention will be described in greater detail with reference to the accompanying drawings. With respect to the elements identical to those of the conventional vacuum cleaner as shown in FIGS. 1 and 2, like reference numerals are assigned.

Figure 3:
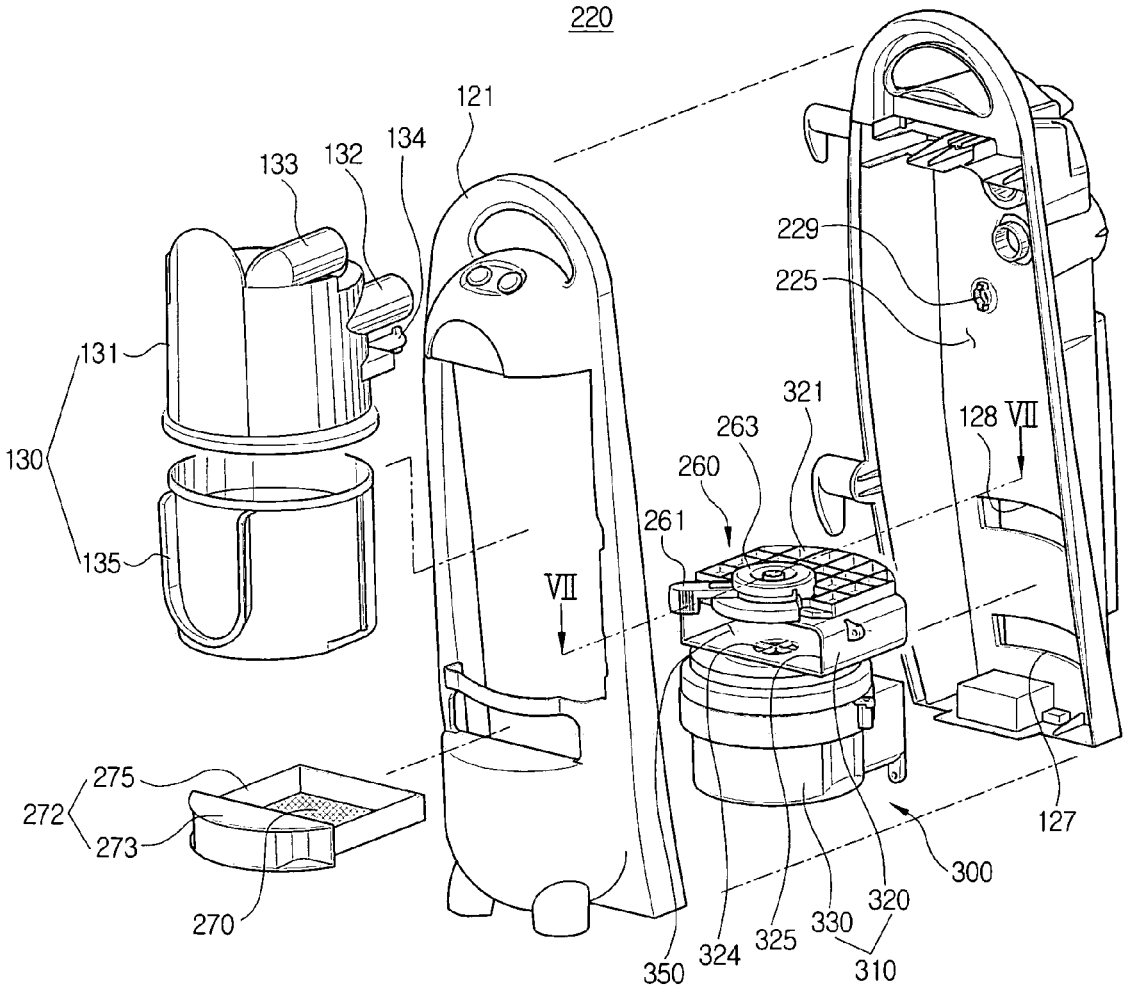
FIG. 3 is a drawing of an exploded perspective view showing a cleaner body of an upright type vacuum cleaner according to a preferred embodiment of the present invention.
Figure 4:
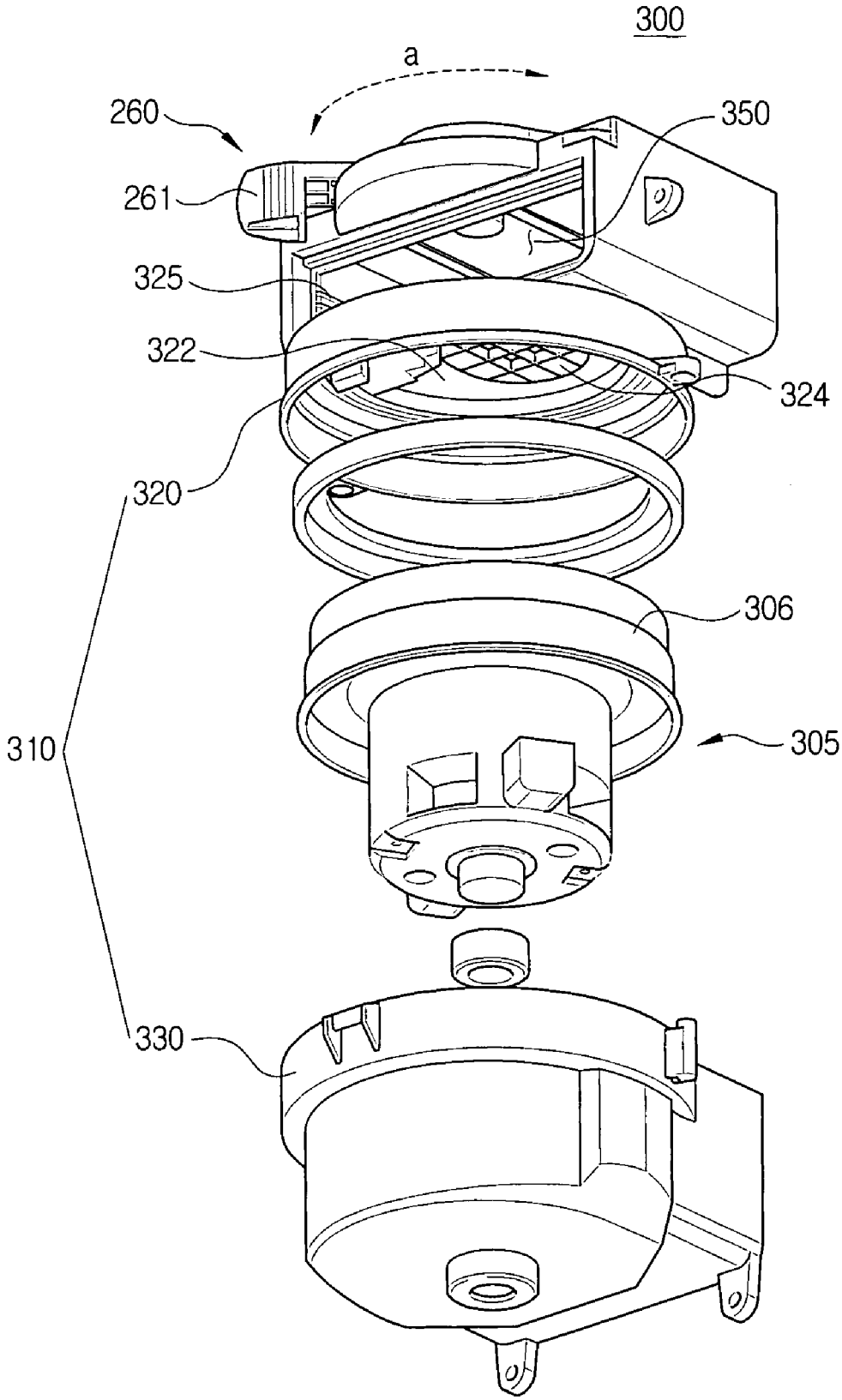
FIGS. 4 and 5 are drawings of exploded perspective views showing the motor assembly of FIG. 3.
Figure 5:
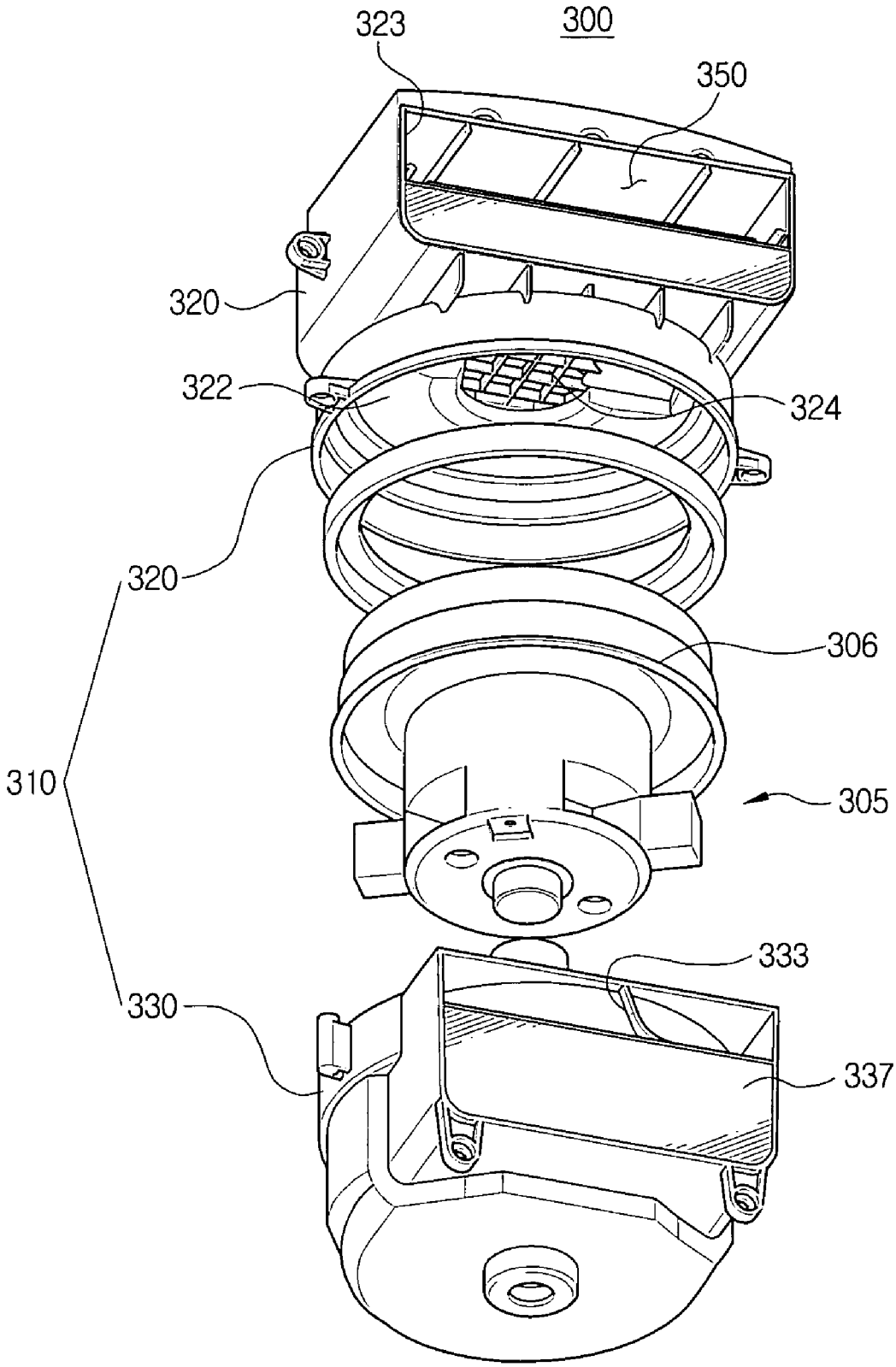

Referring to FIGS. 3-7, a vacuum cleaner according to a preferred embodiment of the present invention includes a cleaner body 220, a cyclone dust-collecting apparatus 130, and a motor assembly 300. As shown in FIG. 3, the cleaner body 220 includes a dust-collecting chamber 225 with a discharge opening 127. The motor assembly 300 is disposed in the cleaner body 220. Accordingly, external air drawn in from outside through a dirt-suctioning opening (not shown) of a suction assembly 110 (see FIG. 1) sequentially passes through the dust-collecting chamber 225 and the motor assembly 300, and is discharged out of the cleaner body 220 through the discharge opening 127.

The cyclone dust-collecting apparatus 130 separates dirt from the external air drawn in through the dirt-suctioning opening. The cyclone dust-collecting apparatus 130 swirls the air drawn in through the dirt-suctioning opening to generate a centrifugal force, and separates dirt from air using the centrifugal force of the swirling current. In that embodiment, the cyclone dust-collecting apparatus 130 includes a cyclone head portion 131 and a dirt-collecting receptacle 135. The cyclone head portion 131 is fixed to an upper end of the dust-collecting chamber 225, and includes an inlet 132 in fluid communication with the dirt-suctioning opening, and an outlet 133 in fluid communication with a motor casing 310, described below. The dirt-collecting receptacle 135 is removably connected to a lower end of the cyclone head portion 131, and that connection forms a cyclone chamber where the external air swirls. A connection member 134 and a connection hole 229 respectively, fix the cyclone head portion 131 to the dust-collecting chamber 225.

The vacuum cleaner with the above construction further includes an ascending/descending unit 260 to connect/disconnect the dirt-collecting receptacle 135 of the cyclone dust-collecting apparatus 130 to/from the cyclone head portion 131. The ascending/descending unit 260 is disposed on a bottom of the dust-collecting chamber 225, and ascends the dirt-collecting receptacle 135 which is inserted in the dust-collecting chamber 225 to connect it with the cyclone head portion 131. The ascending/descending unit 260 includes a lever 261, a disk 263, and a cam driving unit (not shown). The lever 261 is connected to the bottom of the dust-collecting chamber 225 and horizontally pivots with respect to the cleaner body 220 in an arrowed direction 'a' of FIG. 4. The disk 263 which supports a bottom of the dirt-collecting receptacle 135 is disposed on the top surface of the lever 261. The disk 263 vertically moves as the lever 261 is pivoted. Also, the cam driving unit is (not shown) disposed between the lever 261 and the disk 263, for ascending/descending the disk 263 when the lever 261 pivots. The cam driving unit (not shown) can assume numerous embodiments, and thus, because it ascends and descends the disk 263 by the pivotal movement of the lever 261, a detailed description thereof will be omitted.

The motor assembly 300 is disposed in the cleaner body 220, and is positioned at an airflow path connecting the dust-collecting apparatus 130 to the discharge opening 127, and also includes a motor 305 (see FIG. 4), an auxiliary filter member 270, and a motor casing 310. The motor assembly 300 differs from the conventional motor assembly 300 as described above in that the auxiliary filter member 270 is directly and removably disposed in the motor casing 310. Accordingly, since there is no need to have a connecting path connecting the auxiliary filter member 270 and the motor 305, noise can be entirely prevented during driving. Also, since an extra connecting device for connecting the motor 305 and the auxiliary filter member 270 and a sealing device are not required, a manufacturing process of the vacuum cleaner is simplified and a manufacturing cost reduced.

Hereinafter, the motor assembly 300 according to the preferred embodiment of the present invention will be described in greater detail with reference to FIGS. 3-7.

The motor 305 generates a suction force at the dirt-suctioning opening. The motor 305 may use a fan motor, which is typically used in a vacuum cleaner, hence, a detailed description of the motor 305 is omitted. The auxiliary filter member 270 is removably disposed in the motor casing 310, which is later described, and is positioned at the airflow path connecting the cyclone dust-collecting apparatus 130 and the motor 305. Preferably, the auxiliary filter member 270 is made from a porous material such as a sponge to remove dust a second time from the air discharged from the cyclone dust-collecting apparatus 130.

The motor casing 310 includes a first casing 320 and a second casing 330. The first casing 320 encloses an upper portion of the motor 305 where a fan unit 306 for generating an air flux is disposed. The first casing 320 has a first chamber 350 defined therein, and the auxiliary filter member 270 is removably mounted in the first chamber 350. The first casing 320 includes a first port 323, an entrance opening 325, and a connection hole 324. The first port 323 is connected to a suction opening 128 connected to the outlet 133 of the dust-collecting apparatus 130, thereby in fluid communication with the first chamber 350 and the dust-collecting apparatus 130. The connection hole 324 penetrates through approximately a center portion of a bottom 322 of the first casing 320, and as the first casing 320 and the second casing 330 are connected to each other, the connection hole 324 is in fluid communication with the first chamber 350 and a second chamber 360 which will be described below. The entrance opening 325 is exposed to the outside of the cleaner body 220 with the motor casing 310 mounted in the cleaner body 220, and opens one side of the first chamber 350. A mounting member 272 is removably inserted into the entrance opening 325. The mounting member 272 aids in mounting the auxiliary filter member 270 into the first chamber 350, and includes a supporting portion 275 and a cover 273. The supporting portion 275 which supports the auxiliary filter member 270 is placed in the first chamber 350 when the mounting portion 272 is mounted into the first chamber 350.

Figure 7:
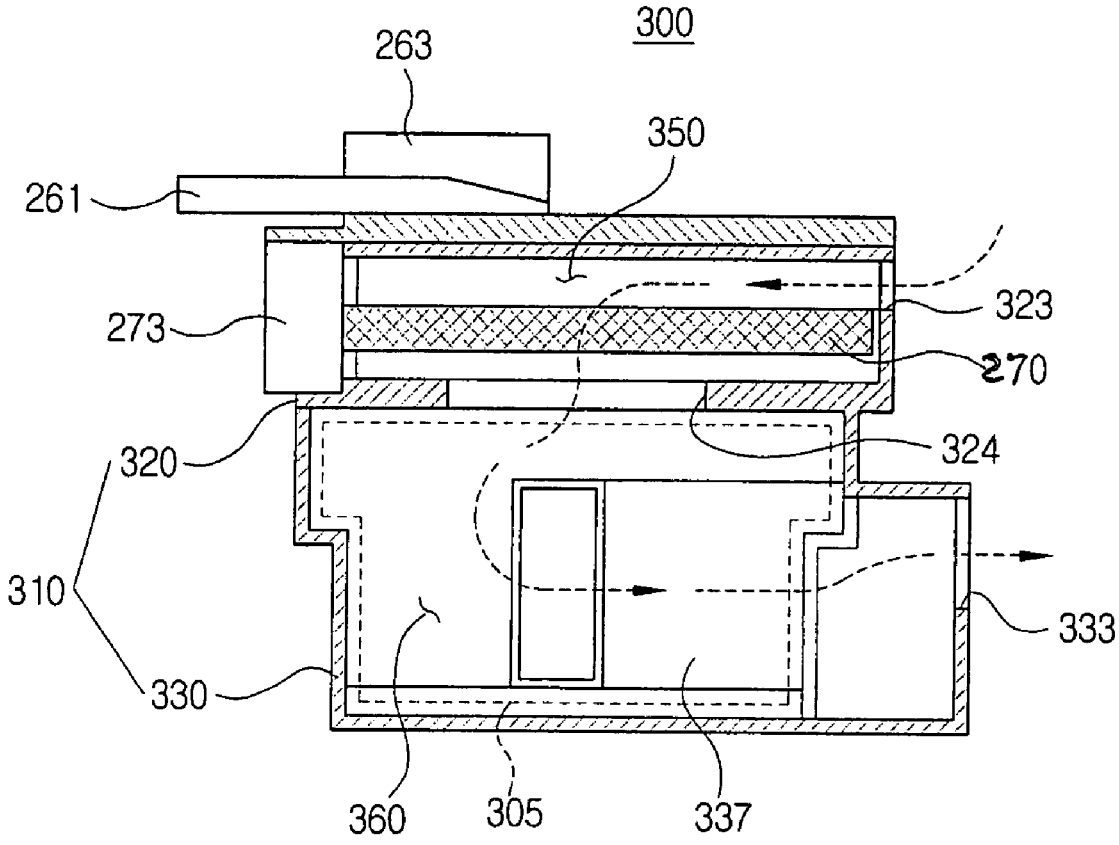
FIG. 7 is a drawing of a cross-sectional view showing the motor assembly according to the preferred embodiment of the present invention taken along the line I-I of FIG. 3.

Accordingly, as shown in FIG. 7, the air discharged from the cyclone dust-collecting apparatus 130 to the first chamber 350 through the first port 323 passes through the auxiliary filter member 270 and the connection hole 324 before being discharged toward the second chamber 360. The air is filtered a second time by the auxiliary filter member 270. Accordingly, filtering efficiency of the vacuum cleaner improves. A sealing member (not shown) may be provided along an edge of the outlet 325 or the cover 273 to prevent air leakage at the cover 273 or the outlet 325.

The second casing 330 is connected to a lower opening 322 of the first casing 320 to form a second chamber 360 in the motor casing 310, and the motor 305 is mounted in the second chamber 360. The second chamber 360 is in fluid communication with the first chamber 350 through the connection hole 324, and also is in fluid communication with the discharge opening 127 of the cleaner body 220 via the second port 333.

Figure 6:
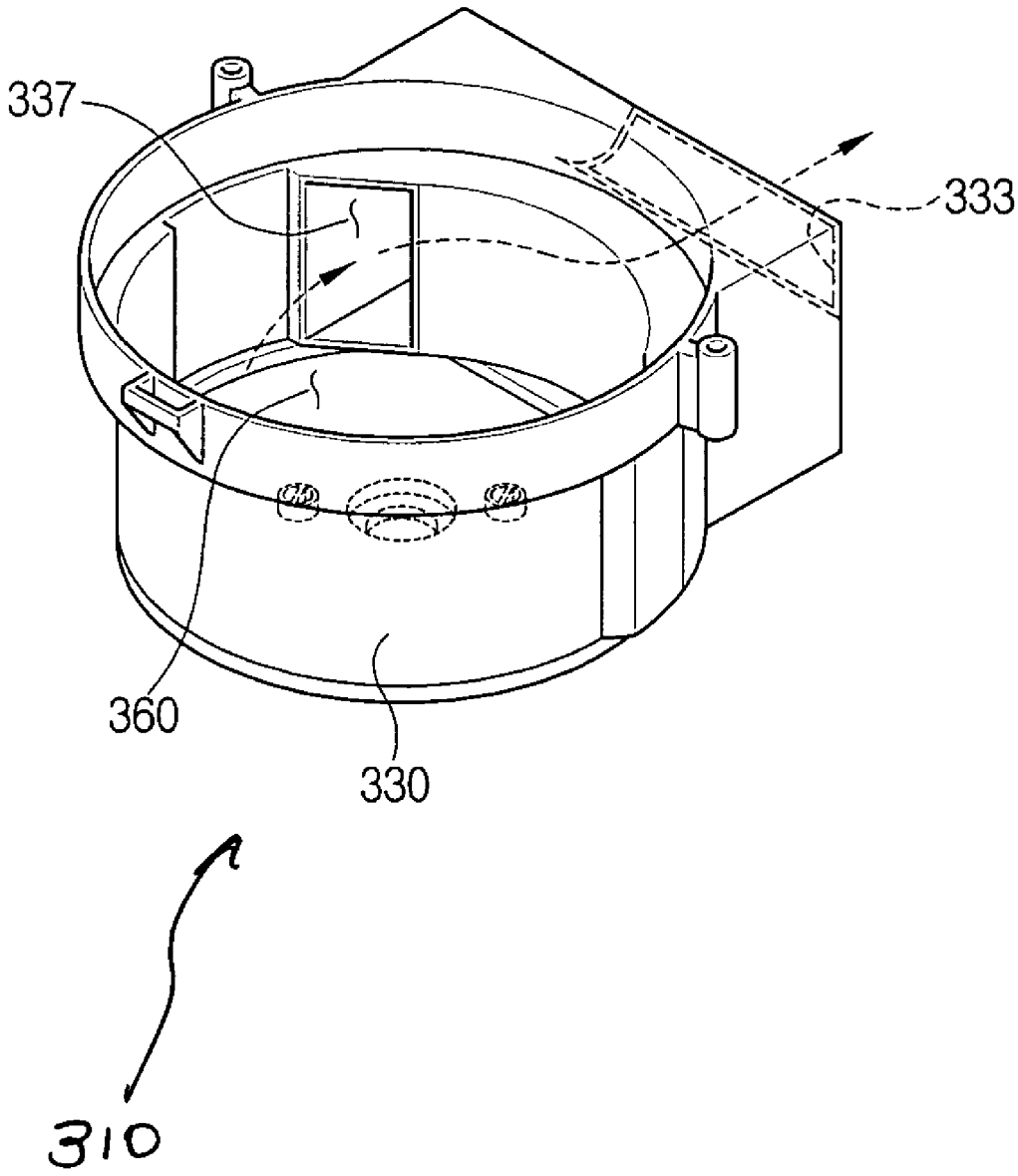
FIG. 6 is a drawing of a perspective view showing an interior of the second casing of the motor assembly according to the preferred embodiment of the present invention.

As shown in FIGS. 6 and 7, the motor casing 310 of the preferred embodiment cause the flow path of the discharged air from the motor 305 to form in a predetermined shape and thus reduce noise caused by the air flux during the operation of the vacuum cleaner. The shape of the airflow path is formed by a guide duct 337 formed on an inner circumference of the second casing 330 in a circumferential direction and extends from the fan unit 306 of the motor 305 to the second port 333. Due to the guide duct 337, the air discharged from the motor 305 is guided to swirl along the inner circumference of the second casing 330 by a predetermined distance and then to discharge to the second port 333. Accordingly, the airflow path is extended to the maximum distance in the motor casing 310 so that the noise of the vacuum cleaner during the driving can be reduced.

The top surface of the motor casing 310 forms a bottom of the dust-collecting chamber 225. Accordingly, the ascending/descending unit 260 is pivotably disposed on the motor casing 310 on a top surface 321 (see FIG. 3) of the first casing 320. Since the motor 305, the auxiliary filter member 270, and the ascending/descending unit 260 are all mounted in the cleaner body 220 when the motor assembly 300 is mounted in the cleaner body 220, a manufacturing process of the vacuum cleaner 100 (see FIG. 1) is simplified.

Although in the above descriptions of the present invention only the upright type vacuum cleaner with the suction assembly 110 (see FIG. 1) pivotably disposed at the lower part of the cleaner body 220 is exemplified, that should not be considered as limiting. The motor assembly 300 can be applied in any vacuum cleaner such as a canister type vacuum cleaner where a suction assembly (not shown) is connected to a cleaner body via a connecting member such as an extension pipe. In that case, the operation and effect of application of the motor assembly 300 are identical to those of the above-described embodiment.

In the conventional upright vacuum cleaner, the motor assembly 150 (see FIG. 2) and the auxiliary filter assembly 140 (see FIG. 1) are independently mounted in the cleaner body 120 (see FIG. 1). According to the present invention, the motor assembly 300 and the auxiliary filter member 270 are integrally mounted in the single motor casing 310, thus not requiring the extra sealing device 180 (see FIG. 2) which is disposed on a connection portion of the motor assembly 150 and the auxiliary filter assembly 140 in the conventional vacuum cleaner.

The noise during the vacuum cleaner operation, which may occur at the connection portion of the motor assembly and the auxiliary filter member, can be prevented, and therefore, a cleaning work can be preformed with minimal noise. Also, since the single motor assembly 300 integrates the functions of the auxiliary filter member 270 and the ascending/descending unit 260 of the cyclone dust-collecting apparatus 130, a manufacturing process and a manufacturing cost of the vacuum cleaner can be reduced.

Since the air discharge path extends from the motor casing 310 by a predetermined distance due to presence of the guide duct 337 formed in the motor casing 310, a driving noise of the vacuum cleaner can be reduced more than that in the conventional vacuum cleaner.

The foregoing embodiment and advantages are merely exemplary and are not to be construed as limiting the present invention. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A motor assembly which is mounted in a cleaner body of a vacuum cleaner to generate a suction force to draw in dirt from a cleaning surface, the motor assembly comprising:

a motor generating the suction force;

an auxiliary filter member disposed on an airflow path connecting the motor to a dust-collecting apparatus in which the dirt is separated from external air drawn in by the suction force, the auxiliary filter member for filtering a second time air discharged from the dust-collecting apparatus; and a motor casing with a first chamber and a second chamber divided therein, and including a connection path in fluid communication with both the first chamber and the second chamber, wherein the first chamber is connected to the dust-collecting apparatus and including the auxiliary filter member mounted therein, and an entrance opening in an outer wall of the cleaner body that is exposed to the outside of the cleaner body, and the auxiliary filter member being removably mounted in the first chamber through the entrance opening and the second chamber connected to a discharge opening of the cleaner body and including the motor mounted therein.

2. The motor assembly of claim 1, wherein the motor casing further comprises a mounting member removably mounted in the first chamber through the entrance opening, the mounting member comprising:

a supporting portion supporting the auxiliary filter member; and a cover disposed at one side of the supporting portion and covering the entrance opening when the supporting portion is inserted into the first chamber to block the entrance opening from the outside of the cleaner body.

3. The motor assembly of claim 2, further comprising a sealing member disposed along an edge of at least one of the entrance opening and the cover.

4. The motor assembly of claim 1, wherein the motor casing comprises:

a first casing in which the first chamber is formed, and including a first port in fluid communication with the first chamber and the dust collecting apparatus; and a second casing connected to the first casing to form the second chamber in the motor casing, and including a second port connecting the second chamber to the discharge opening of the vacuum cleaner, the connection path includes a connection hole penetratingly formed in one side of the first casing, to connect the first and the second chambers when the first and the second casings are connected to each other.

5. The motor assembly of claim 4, wherein the second casing further comprises a guide duct guiding the air which is drawn into the second chamber through the connection hole so that the air swirls in the second casing along a circumferential direction of the motor by a predetermined distance and is then discharged though the second port.

6. The motor assembly of claim 1, wherein the motor casing further comprises a guide duct guiding the air which is drawn into the second chamber through the connection path so that the air swirls in the motor casing along a circumferential direction of the motor for a predetermined distance and is discharged through the discharge opening.

7. A vacuum cleaner comprising:

a suction assembly with a dirt-suctioning opening;

a cleaner body pivotably disposed at one side of the suction assembly and including a dust-collecting chamber and a discharge opening sequentially disposed therein and in fluid communication with the dirt-suctioning opening;

a motor assembly disposed in the cleaner body to generate a suction force at the dirt-suctioning opening, and including an upper outside wall forming a bottom of the dust-collecting chamber; and a dust-collecting apparatus disposed in the dust-collecting chamber to separate dirt from external air drawn in through the dirt-suctioning opening, wherein the motor assembly comprises:

a motor generating the suction force; and a motor casing including a first chamber and a second chamber divided therein, and including a connection path in fluid communication with both the first chamber and the second chamber, the first chamber being in fluid communication with the dust-collecting apparatus and including an auxiliary filter member mounted therein for filtering a second time air discharged from the collecting apparatus, the second chamber connected to the discharge opening of the cleaner body and including the motor mounted therein.

8. The vacuum cleaner of claim 7, wherein one side of the first chamber is opened by an entrance opening which penetrates through an outer wall of the cleaner body and is exposed to the outside of the cleaner body, and the auxiliary filter member is removably mounted in the first chamber through the entrance opening.

9. The vacuum cleaner of claim 8, wherein the motor casing further comprises a mounting member removably mounted in the first chamber through the entrance opening, the mounting member comprising:

a supporting portion supporting the auxiliary filter member; and a cover disposed at one side of the supporting portion for covering the entrance opening when the supporting portion is inserted into the first chamber to block the entrance opening from the outside of the cleaner body.

10. The vacuum cleaner of claim 9, further comprising a sealing member disposed along an edge of at least one of the entrance opening and the cover.

11. The vacuum cleaner of claim 7, wherein the motor casing comprises a guide duct guiding the air which is drawn into the second chamber through the connection path so that the air swirls in the motor casing along a circumferential direction of the motor by predetermined distance and is discharged through the discharge opening.

12. The vacuum cleaner of claim 7, wherein the motor casing comprises:

a first casing in which the first chamber is formed, and including a first port in fluid communication with the first chamber and the dust collecting apparatus; and a second casing connected to the first casing to form the second chamber in the motor casing, and including a second port connecting the second chamber to the discharge opening of the cleaner body, the connection path including a connection hole penetratingly formed in one side of the first casing connecting the first and the second chambers when the first and the second casings are connected to each other.

13. The vacuum cleaner of claim 12, wherein the second casing further comprises a guide duct guiding the air which is drawn into the second chamber through the connection hole so that the air swirls in the second casing along a circumferential direction of the motor by a predetermined distance and is discharged through the second port.

14. The vacuum cleaner of claim 12, wherein the dust-collecting apparatus comprises a cyclone dust-collecting apparatus which separates dirt from air by using a centrifugal force generated by swirling the air drawn in through the dirt-suctioning opening, and the cyclone dust-collecting apparatus comprises:

a cyclone head portion fixed to an upper end of the dust-collecting chamber and is in fluid communication with the dirt-suctioning opening and the motor casing; and a dirt-collecting receptacle removably disposed at a lower end of the cyclone head portion to form a cyclone chamber, the dirt centrifugally separated at the cyclone chamber and collected on the dirt-collecting receptacle.

15. The vacuum cleaner of claim 14, wherein the dust-collecting chamber is provided with an ascending/descending unit ascending the dirt-collecting receptacle and inserted into the dust-collecting chamber to connect the dirt-collecting receptacle to the cyclone head portion, the ascending/descending unit disposed on an upper outside wall of the motor assembly.

16. The vacuum cleaner of claim 15, wherein the ascending/descending unit comprises:

a lever pivotably disposed at the upper outside wall of the motor assembly;

a disk disposed on an upper portion of the lever in a vertically movable manner for supporting a lower surface of the dirt-collecting receptacle inserted in the dust-collecting chamber; and a cam driving unit disposed between the level member and the disk for ascending/descending the disk when the lever pivots.

17. A motor assembly of a vacuum cleaner, which is mounted in a cleaner body to generate a suction force to draw in dirt from a cleaning surface, the motor assembly comprising:

a motor generating the suction force; and a motor casing including a chamber formed therein to mount the motor and a first port connecting the chamber to a dust-collecting apparatus separating the dirt from external air drawn into the cleaner body by the suction force and a second port connecting the chamber to a discharge opening of the cleaner body, the motor casing comprising a guide duct guiding the air drawn in though the first port so that the air swirls in the motor casing along a circumferential direction of the motor by a predetermined distance and is discharged through the second port, and a first chamber and a second chamber divided by a partition traversing inside the casing.

18. The motor assembly of claim 17, wherein the first chamber is formed on an airflow path connecting the first and the second ports, and an auxiliary filter member is removably disposed in the first chamber for filtering the air drawn into the first chamber through the first port.

19. The motor assembly of claim 18, wherein one side of the first chamber is opened by an entrance opening which penetrates through an outer wall of the cleaner body and is exposed to the outside of the cleaner body, and the auxiliary filter member is removably mounted in the first chamber through the entrance opening.

20. The motor assembly of claim 19, wherein the motor casing further comprises a mounting member removably mounted in the first chamber through the entrance opening, and the mounting member comprises:

a supporting portion supporting the auxiliary filter member and including a plurality of penetrating holes enabling a fluid communication between the first port and the second chamber; and a cover disposed at one side of the supporting portion, to cover the entrance opening when the supporting portion is inserted into the first chamber.

21. The motor assembly of claim 17, wherein the second chamber is connected to the first chamber through a predetermined connection path, and the motor is mounted in the second chamber.

22. The motor assembly of claim 17, wherein the connection path is a connection hole penetratingly formed in the partition.

* * * * *